US008453703B2

(12) United States Patent
Talboys

(10) Patent No.: US 8,453,703 B2
(45) Date of Patent: Jun. 4, 2013

(54) SELF-STORING VERTICAL LIFT DOOR SYSTEM

(76) Inventor: Thomas D. Talboys, Birmingham, MI (US)

( * ) Notice: Subject to any disclaimer, the term of this patent is extended or adjusted under 35 U.S.C. 154(b) by 0 days.

(21) Appl. No.: 13/216,512

(22) Filed: Aug. 24, 2011

(65) Prior Publication Data

US 2012/0047804 A1 Mar. 1, 2012

Related U.S. Application Data

(60) Provisional application No. 61/376,474, filed on Aug. 24, 2010.

(51) Int. Cl.
*E05D 15/00* (2006.01)

(52) U.S. Cl.
USPC ..... 160/36; 160/201

(58) Field of Classification Search
USPC ..... 160/32, 34, 35, 36, 201, 33, 133; 49/126, 49/203, 204, 205
See application file for complete search history.

(56) References Cited

U.S. PATENT DOCUMENTS

| | | | | | |
|---|---|---|---|---|---|
| 1,985,976 | A | * | 1/1935 | Clark | 160/209 |
| 2,729,287 | A | | 1/1956 | Goldner | |
| 2,839,135 | A | * | 6/1958 | Anderson | 160/133 |
| 2,897,886 | A | * | 8/1959 | Pistelli | 160/33 |
| 3,204,691 | A | | 9/1965 | Rohrman | |
| 3,280,888 | A | | 10/1966 | Davis | |
| 3,304,994 | A | | 2/1967 | Kozak | |
| 4,379,478 | A | * | 4/1983 | Lichy | 160/35 |
| 4,460,030 | A | * | 7/1984 | Tsunemura et al. | 160/35 |
| 4,538,661 | A | * | 9/1985 | Henry et al. | 160/35 |
| 4,595,043 | A | * | 6/1986 | Nozawa et al. | 160/36 |
| 4,662,420 | A | * | 5/1987 | Hirao | 160/32 |
| 4,838,331 | A | * | 6/1989 | Kasai | 160/36 |
| 5,065,806 | A | * | 11/1991 | Kondoh | 160/36 |
| 5,072,766 | A | * | 12/1991 | Kondoh et al. | 160/36 |
| 5,133,398 | A | * | 7/1992 | Yang et al. | 160/33 |
| 5,172,742 | A | * | 12/1992 | Iwasaki et al. | 160/36 |
| 5,685,355 | A | * | 11/1997 | Cook et al. | 160/202 |
| 6,041,843 | A | | 3/2000 | Mullet | |
| 6,260,601 | B1 | * | 7/2001 | Thomas | 160/133 |
| 6,321,819 | B1 | | 11/2001 | Copp et al. | |

* cited by examiner

*Primary Examiner* — David Purol
(74) *Attorney, Agent, or Firm* — Gifford, Krass, Sprinkle, Anderson & Citkowski, P.C.

(57) ABSTRACT

A vertical lift, self-storing door system includes a plurality of panels supported by a first and a second single track guide rail which engages guide rollers associated with the panels. The guide rail has a vertical segment which defines a closed position of the door and a horizontal segment which defines an open, storage position for the door. When the door is closed, the individual panels are stacked in an edge-to-edge relationship so that their front faces are coplanar. When the door is in an open position, the panels hang vertically from the guide rails in a spaced apart, generally plane parallel relationship with regard to their front and rear faces. Bevels in the top and bottom edges of the panels accommodate panel motion and ensure a tight seal when the door is in a closed position, and these bevels may include connecting features such as notches or tabs.

10 Claims, 6 Drawing Sheets

FIG. 9
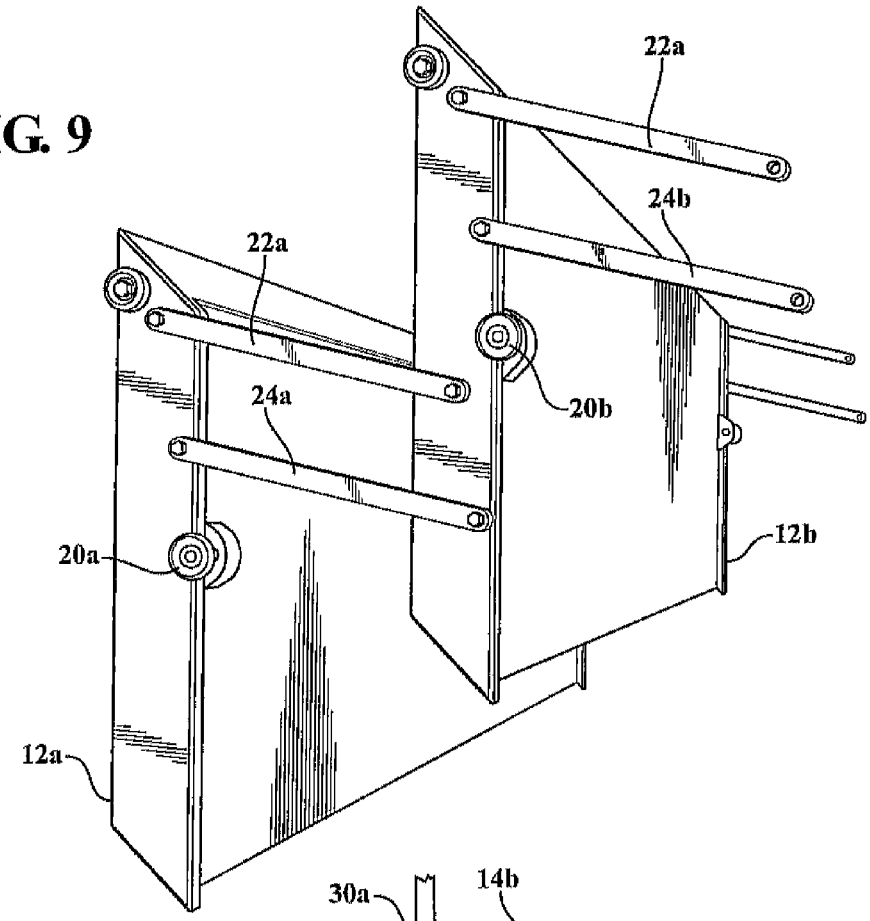
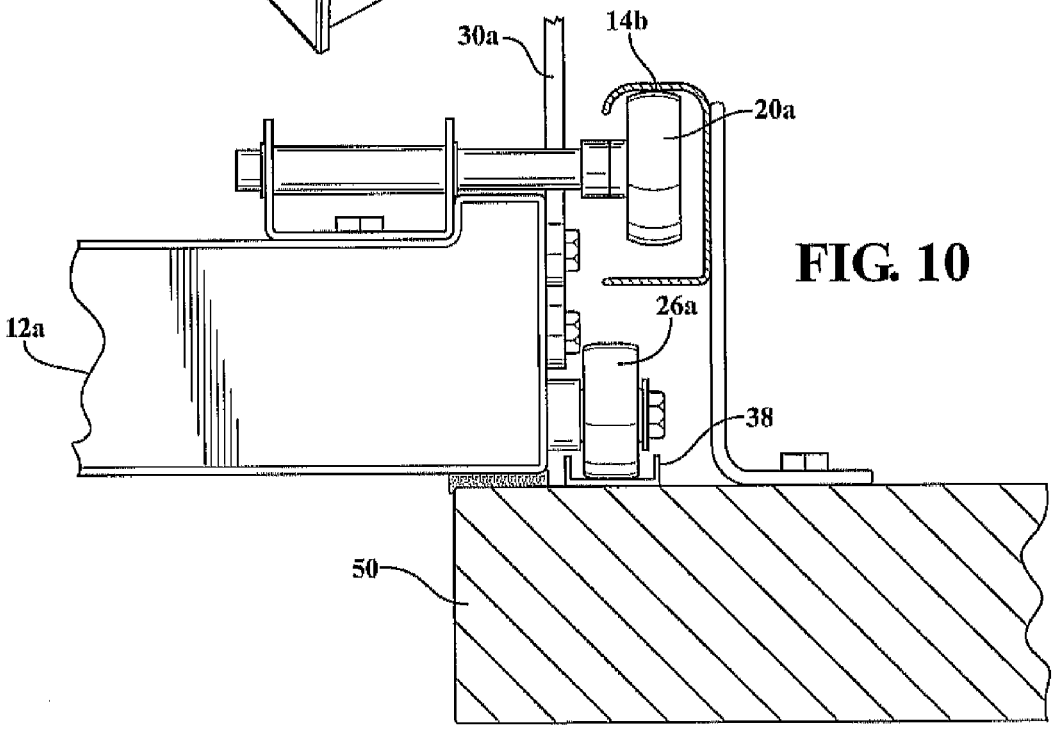
FIG. 10

SELF-STORING VERTICAL LIFT DOOR SYSTEM

CROSS-REFERENCE TO RELATED APPLICATIONS

This application claims priority of U.S. Provisional Patent Application No. 61/376,474 filed Aug. 24, 2010, the contents of which are incorporated herein by reference.

FIELD OF THE INVENTION

This invention relates generally to doors and more specifically to vertical lift doors. In particular, the system relates to a self-storing vertical lift door system including a plurality of separate panels which, when the door is opened, are disposed in a compact, hanging relationship.

BACKGROUND OF THE INVENTION

Vertical lift doors have long been in use in both commercial and residential garages as well as in industrial facilities such as warehouses, factories, and the like. Increasingly, vertical lift doors are being incorporated into consumer-directed, commercial buildings such as restaurants and retail establishments, so as to permit these buildings, under appropriate conditions, to be opened to the ambient atmosphere.

In a typical vertical lift door system, a door is moved from a closed position to an open, storage position. In most instances, the door is comprised of a single, unitary body which is moved from a vertical, closed position along a series of tracks or guides to a horizontal storage position, typically under the ceiling of the building structure. The horizontal storage of the large door panel consumes a large amount of useful ceiling space in the building structure, which space could otherwise be utilized productively. Also, in those instances where vertical lift doors are associated with consumer-oriented applications such as retail or restaurants, the presence of an overhead door can be unsightly. In addition to these problems, the horizontal storage imposes mechanical forces on the door which can tend to warp the door unless reinforcing members are included. As a consequence of these limitations, the art has looked to alternative vertical door structures.

One such alternative comprises roll-up doors which include a corrugated, flexible door structure which is wound into an overhead storage drum. While these doors can be quite sturdy, their high weight, mechanical complexity, and high cost tend to restrict their utility to heavy duty commercial applications. In addition, the appearance of such doors generally limits their use in residential and consumer oriented applications.

Other vertical door systems include accordion folded door members comprised of a plurality of interconnected panels which are variously conveyed from a closed configuration to an open, storage configuration. The interconnected nature of the panels makes these door systems very difficult to install and maintain, and these systems tend to be expensive and mechanically complex. Some accordion fold door systems are shown in U.S. Pat. Nos. 4,460,030; 3,280,888; and 4,538,661. Cascade door systems are similar to accordion fold systems insofar as they rely upon the use of a door structure comprised of a plurality of panels interconnected into a loop structure. These systems, in addition to being expensive and mechanically complex, tend to occupy relatively large volumes in a stored condition. One such system is shown in U.S. Pat. No. 6,041,843.

In efforts to overcome the problems associated with door systems comprised of linked, accordion fold, or cascade panels, the art has looked to implement hanging panel systems in which a door member is comprised of a plurality of panels which, in a closed condition, cooperate to provide a door structure and which, in an open condition, are disposed in a separated, vertical, side-by-side relationship. While such systems have the potential for allowing for storage of a vertical door in a relatively small compact area, practical implementation of this concept has not heretofore been achieved. For example, U.S. Pat. No. 4,379,478 shows a hanging panel door system which relies upon the use of a pair of relatively complex dual track members for retaining and moving a series of panel members. Furthermore, the panels employed in the system are mechanically complex and include a specific caroming mechanism for assuring their proper motion along the tracks. Another approach implemented in the prior art is depicted in U.S. Pat. No. 3,304,994. This patent shows a hanging panel door system in which a series of cables is employed to move door panels from an overhead storage position to a closed position wherein the panels overlie one another in a shingled relationship. As such, the closed door does not present a uniform, flat surface but rather comprises a plurality of overlapping members. Since the panels do not directly support one another, this system has problems of mechanical stability in addition to being aesthetically unacceptable to many consumers.

As will be detailed hereinbelow, the present invention provides a vertical lift door system which is based upon the use of a plurality of separate panel members which are movable from a hanging, storage position in which the panels are spaced apart in a generally parallel relationship to a closed, use position in which the panels are stacked edge to edge to present a solid, mechanically stable door structure. As will be detailed hereinbelow, the system of the present invention is mechanically simple and does not rely upon the use of complex dual track structures, nor does it require camming members or other such precision mechanical components. The system of the present invention may be implemented in a modular mode wherein individual panels may be configured to particular applications and/or readily replaced. These and other advantages of the invention will be apparent from the drawings, discussion, and description which follow.

BRIEF DESCRIPTION OF THE INVENTION

Disclosed is a multiple panel, self-storing, vertical lift door system which is comprised of a first and a second single track guide rail, each guide rail having a vertical segment and a horizontal segment. The system further includes a plurality of door panels, each door panel having a front face, a back face, a top edge, a bottom edge, a first side edge, and a second side edge. Each panel also includes a first guide roller supported on the first side edge, and the first guide roller is engageable with the first guide rail so as to be displaceable therealong. Each panel also includes a second guide roller supported on its second side edge. This second guide roller is engageable with the second guide rail so as to be displaceable therealong. When the guide rollers are engaged with the horizontal segments of their respective guide rails, they support the panels in a vertical relationship so that the bottom edges of the panels are in a coplanar relationship and the front faces of the panels are in a plane parallel relationship. When the guide rollers are engaged with the vertical segment of the guide rails, they support the panels in a vertical relationship so that the front faces of the panels are in a coplanar relationship and the bottom edges of the panels are in a plane parallel relationship.

The door system further includes a plurality of primary connector links disposed and operative to pivotally connect the first edge of one of the panels to the first edge of another, adjoining panel and the second edge of one of said panels to the second edge of the other adjoining panel. The door further includes a drive system for moving the plurality of panels and their associated rollers along the first and second tracks between the vertical segment and the horizontal segment. In this manner, when the panels are disposed in the vertical segment, the door is in its closed position and when the panels are disposed in the horizontal segment, the door is in its open, storage position.

In specific embodiments, the door system further includes a plurality of secondary connector links each disposed so as to be pivotally affixed to an adjacent pair of door panels in a parallel relationship with a corresponding one of the primary connector links. In various embodiments, the panels each include a first bracket which at least partially defines a first edge of the panel and a second bracket which at least partially defines a second edge of the panel. In some such instances, a facing member may be attached to the brackets, and this facing member may at least partially define the top edge, the bottom edge, the front face, and the back face of the panel. In the bracket-including embodiments, the first and second rollers, as well as the primary and secondary links (if present), may be coupled to respective brackets.

In specific embodiments, the top edge and the bottom edge of at least some of the panels are beveled so as to improve the mechanical integrity of the door system when the panels are in the closed, vertically stacked relationship; and in particular instances, these bevels may include notches or other coupling features therein.

In certain specific embodiments, at least some of the panels of the door system may include a retention roller thereupon which is operative to retain the panel in a spaced apart relationship with a support surface, such as a surface of a garage or other building, or additionally provided support surface, when the door is in its closed position. In various embodiments, the drive system includes an electric motor and, in particular instances, the drive system may be under wireless remote control.

BRIEF DESCRIPTION OF THE DRAWINGS

FIG. 9 is a perspective view of two of the panel members of the door system of FIG. 8, at a position intermediate the open and closed state and better illustrating the mechanical interaction of various of the mechanical elements; and FIG. 10 is a top, cross-sectional view of a portion of the door system of FIG. 8, specifically illustrating the interaction of the guide rollers and guide rail and retention roller and support surface.

DETAILED DESCRIPTION OF THE PREFERRED EMBODIMENTS

The present invention is directed to vertical lift door systems which are comprised of a plurality of separate panels which are supported by a pair of single channel track members. When the door is in a closed position, the panels are supported in a vertically stacked edge-to-edge arrangement so as to present a unitary door surface. When the door is in an open position, the panels are separately and vertically suspended from a horizontal portion of the tracks so that these panels are in a spaced apart, generally plane parallel, vertical relationship. The present invention may be implemented in a variety of configurations. Some specific implementations of the invention will be shown herein, and it is to be understood that yet other embodiments may be implemented in accord with the principles of the present invention.

Figure 1:
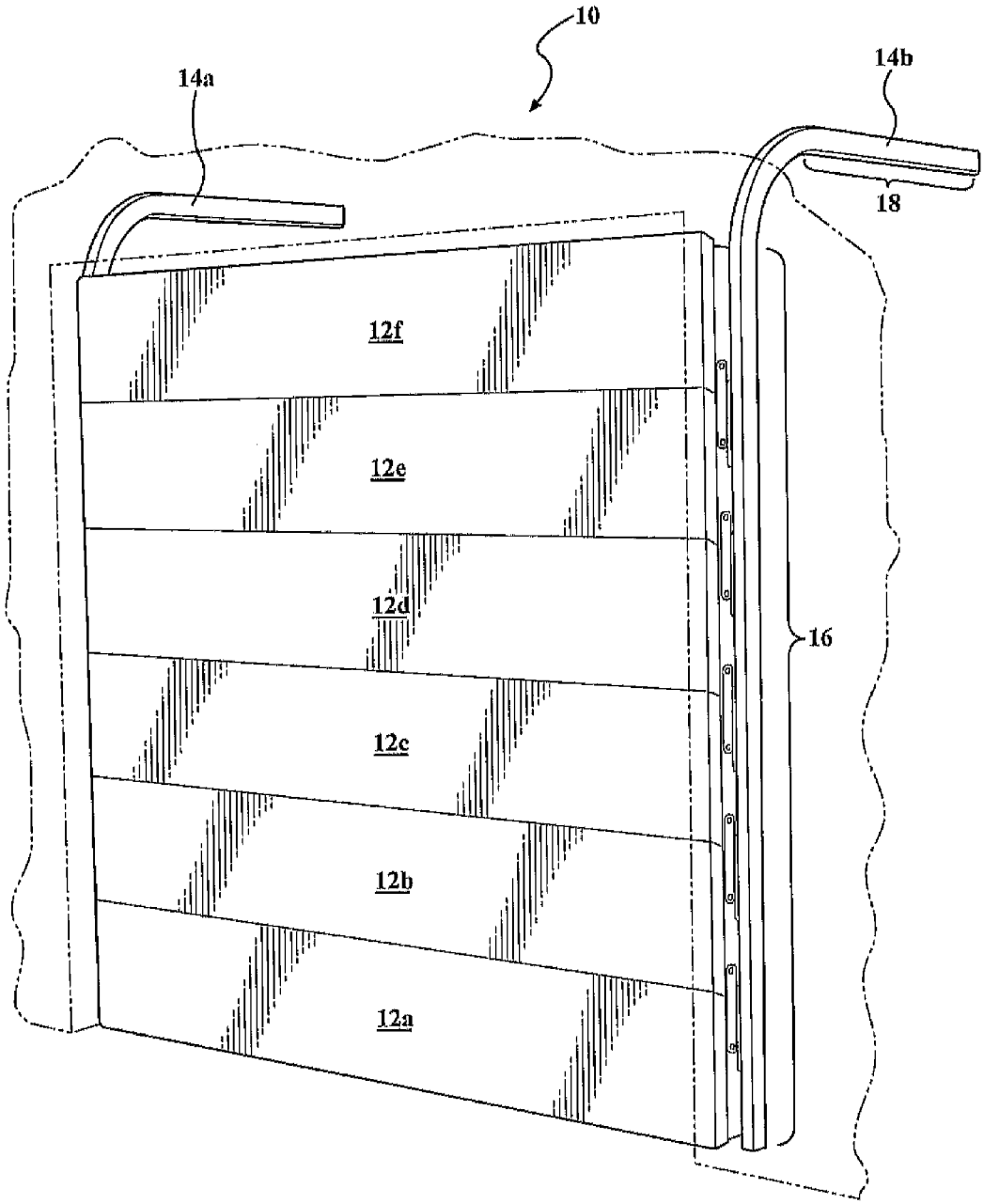
FIG. 1 is a perspective view of a door system of the present invention as shown in its closed position.

Referring now to FIG. 1, there is shown one embodiment of door system 10 which includes a plurality of door panels 12*a*-12*f*. The door of FIG. 1 is in a closed position, and the panels 12*a*-12*f* are vertically stacked in an edge-to-edge relationship. The panels 12*a*-12*f* are retained by a pair of single track guide rails 14*a*, 14*b*. The guide rails 14*a*, 14*b* are of relatively simple construction, as will be explained hereinbelow, and define a single, non-branched track which supports and guides the panels 12*a*-12*f*. This single track arrangement is in contrast to prior art door systems such as those discussed hereinabove. The guide rails include a vertical segment, such as segment 16 of rail 14*b*, and this vertical segment engages the panels 12*a*-12*f* when they are in their closed, vertical position. The guide rails 14*a*, 14*b* further include a horizontal segment such as segment 18 of rail 14*b* which, as will be explained with regard to FIG. 2, supports the panels 12*a*-12*f* in a vertical, plane parallel relationship when the door is open.

Figure 2:
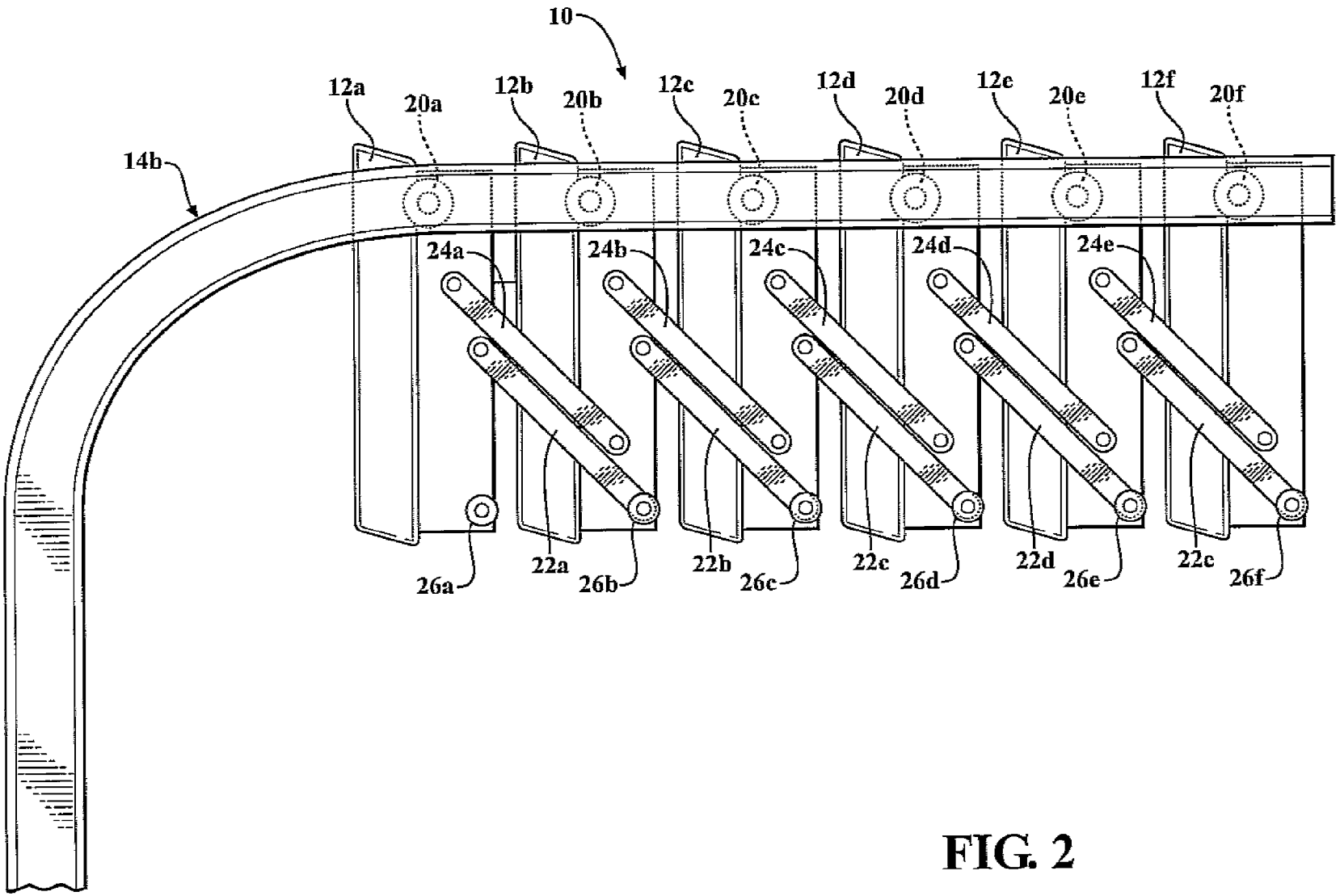
FIG. 2 is a right side view of a door system of the present invention in its open, storage position.

Referring now to FIG. 2, there is shown a side view of the door system 10 of FIG. 1 as disposed in its open, storage position. In that regard, the door panels 12*a*-12*f* are suspended from the horizontal section 18 of the track 14*b* by means of guide rollers 20*a*-20*b* associated with a first side edge of each of the panels and shown herein in phantom outline. A similar set of rollers are associated with the second side edge of each of the panels, and are not visible in this figure. It will be seen that when the panels 12*a*-12*f* are in their storage position they are hanging vertically and are spaced apart from one another so that they are in an approximately plane parallel relationship. It will be further noted from FIG. 1 that the individual panels 12*a*-12*f* are each coupled to an adjoining panel by means of a number of connector links. As shown in FIG. 2, two connector links, referred to as a primary connector link and a secondary connector link, are used to join each panel to an adjacent panel, although it is to be understood that in other implementations connection may be accomplished by a single link or by more than two links.

Specifically, in FIG. 2 primary connector link 22*a* connects panel 12*a* to panel 12*b*, primary connector link 22*b* connects panel 12*b* to panel 12*c*, primary connector link 22*c* connects panel 12*c* to panel 12*d*, primary connector link 22*d* connects panel 12*d* to panel 12*e*, and primary connector link 22*e* connects panel 12*e* to panel 12*f*. These connections are referred to as pivotal connections insofar as the link is free to pivot about its connection point to the panels so as to allow for relative motion between the panels. In FIG. 2, secondary connector links 24*a*-24*e* are disposed generally parallel to primary connector links 22*a*-22*e* and further serve to connect adjoining panels. It has been found that inclusion of the secondary connector links, while not necessary, does aid in assuring smooth motion of the panels along the track.

It will be further noted from FIG. 2 that the panels 12*a*-12*e* each include a retention roller 26*a*-26*e* associated therewith. The retention roller, while not necessary to the present invention, provides further improvements thereto insofar as it allows for the panels, when the door is closed, to be retained in a spaced apart relationship with a support surface such as a portion of the building. These rollers will be explained in greater detail hereinbelow.

Figure 3:
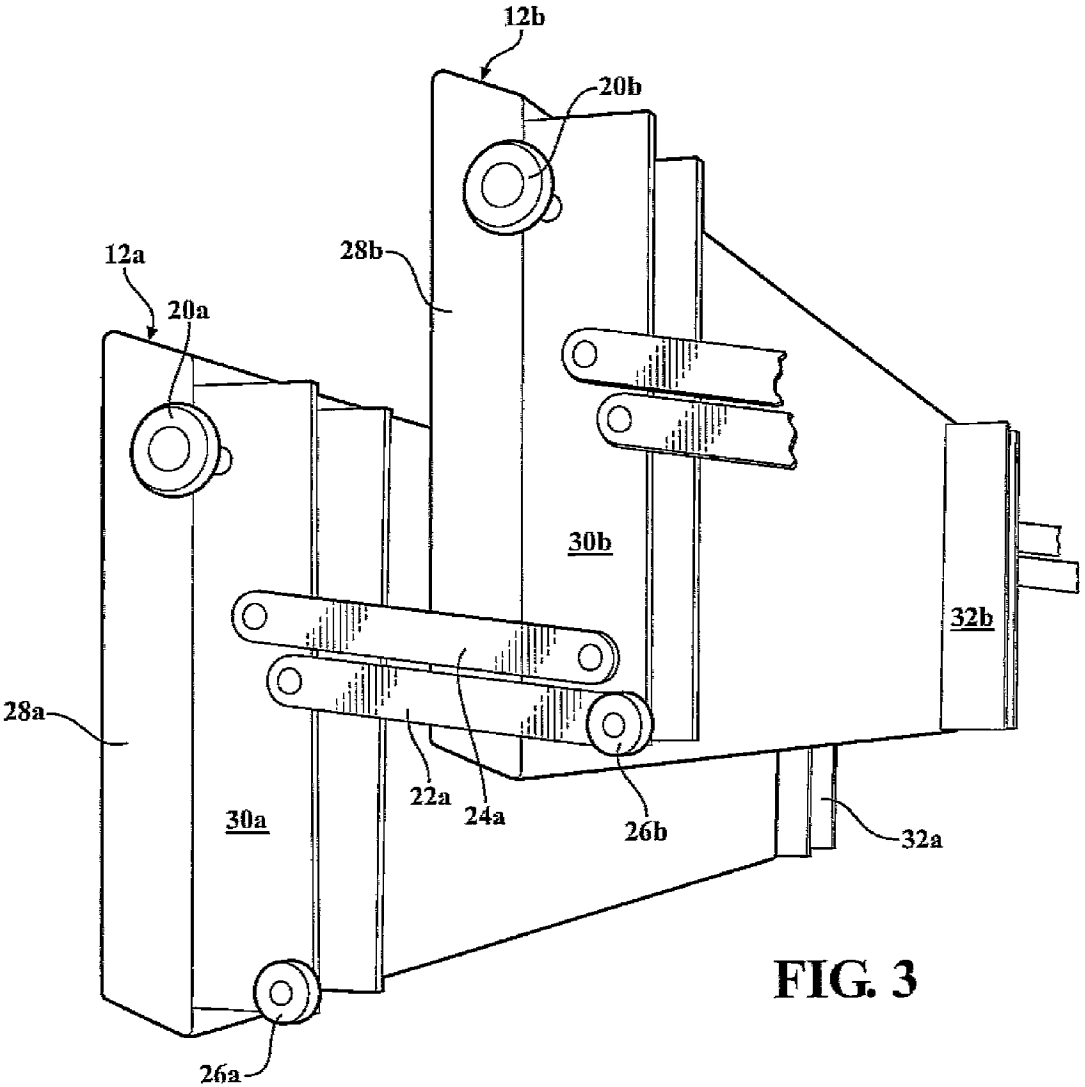
FIG. 3 is a perspective view of two of the panel members of a door system of the present invention at a position intermediate the open and closed state and better illustrating the mechanical interaction of various of the mechanical elements.

FIG. 3 is a perspective view of two panels 12*a*, 12*b* as shown in an intermediate position between the horizontal and vertical sections of the track. The panels are in this configuration when the door is in the process of opening or closing. In the illustrated embodiment, the panels are comprised of a facing member 28 having a pair of brackets 30, 32 affixed to its back surface. In the illustrated embodiment, the primary connector links 22 and secondary connector links 24 are affixed to the brackets as are the guide rollers 20 and the retention rollers 26.

As illustrated, the panels are generally rectangular in shape and include a front face, a back face, a top edge, a bottom edge, a first side edge, and a second side edge. The various rollers and connector links join to the respective side edges of the panels; and in the FIG. 3 embodiment, the brackets form a portion of the side edges of the panels.

Figure 6:
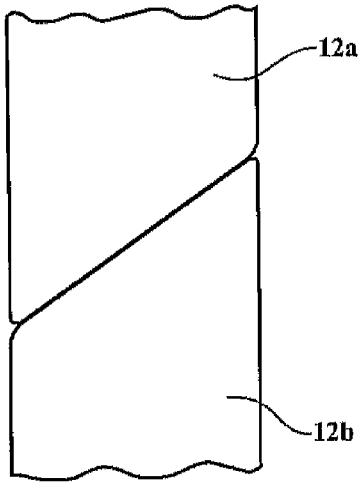
FIG. 6 is a cross-sectional view of portions of two door panels having beveled edges.
Figure 7:
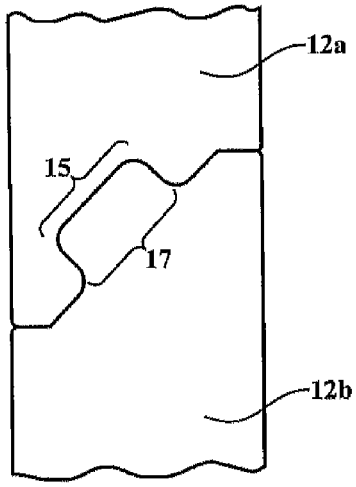
FIG. 7 is a cross-sectional view of portions of two door panels illustrating incorporation of a locking feature into the beveled edges of the door panels.

Using a bracket and panel arrangement as shown in FIG. 3 allows for great flexibility in the implementation of the door system since panels may be readily fabricated by connecting brackets to appropriate lengths of a facing material so as to allow for custom fabrication of various door styles utilizing facing members fabricated from wood, synthetic materials, composites, metal, or the like. In this manner, a homeowner can customize the appearance of the door and/or readily change it as need be. It is to be understood that yet other features may be incorporated into the panel such as reinforcement members, windows, and the like. As will be seen from FIGS. 2 and 3, the top and bottom edges of at least some of the panels are beveled, and this beveling greatly enhances the integrity and operability of the door system by allowing for close clearance between a top edge of one panel and the bottom edge of an adjacent panel when they are traversing a portion of the track between the vertical and horizontal components. In addition, the beveled structure has been found to enhance the integrity of the door when it is in the closed position since the bevels prevent one panel from sliding past another when a compressive force is applied thereto from its front or rear face, as would happen when the door was under a load from wind or unwanted impact. In addition, the bevel provides a weather-tight seal which can prevent wind, rain, and dust from entering a building structure. FIG. 6 is an enlarged view of two portions of door panels 12*a*, 12*b* showing the beveled junction therebetween, and it will be seen from this figure how a horizontally applied force in the direction of arrow A is accommodated so as to enhance the seal between the panels. FIG. 7 shows an alternative embodiment of the beveled connection wherein a connecting feature such as the notch and tab arrangement is incorporated into the panels 12*a*, 12*b* so as to lock them together. In this manner, panel 12*a* includes a notch 15 in its beveled edge and panel 12*b* includes a corresponding tab 17 which engages the notch.

Figure 4:
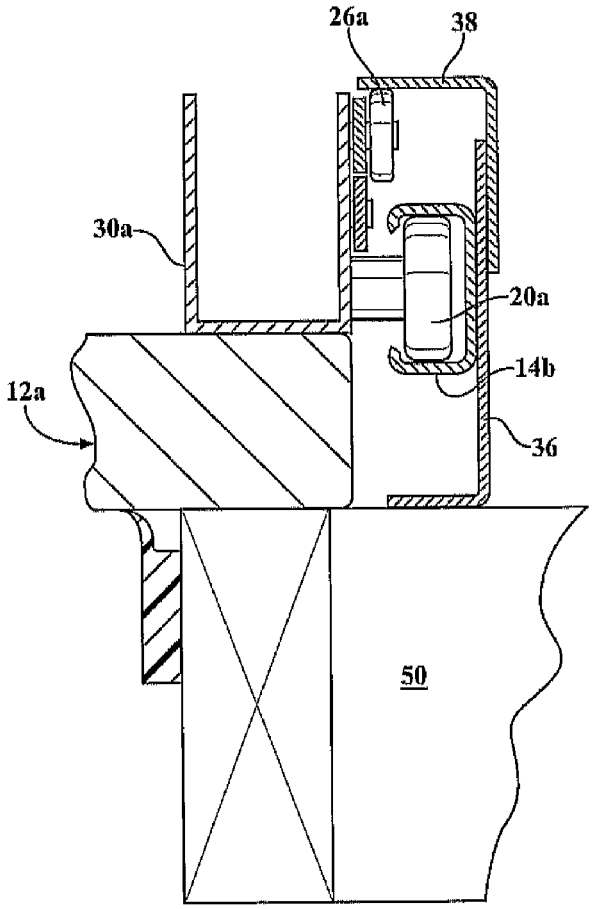
FIG. 4 is a top, cross-sectional view of a portion of the door system of the present invention specifically illustrating the interaction of the guide rollers and guide rail and retention roller and support surface.

Referring now to FIG. 4A, there is shown a partial, cross-sectional view of the door assembly in its closed position. As shown in FIG. 4, the panel 12*a* is supported in its guide rail 14*b* by a guide roller 20*a*, and the guide rail 14*b* is in turn supported on a building structure 50 as, for example, by a bracket 36. As is further shown in the FIG. 4 illustration, the panel 12*a* includes a retention roller 26*a* which is supported on a side of the panel 12*a* which is partially comprised by the bracket 30*a*. The retention roller 26*a*, as mentioned above, serves to retain the panel in a spaced apart relationship with a support structure such as a building and further enhances the integrity of the door system. In the FIG. 4 illustration, the retention roller 26*a* is disposed so as to engage a support rail 38 which, in this instance, is also supported by the bracket 36. In some instances, the support rail may comprise a strip of metal or the like which is directly affixed to a door frame or other portion of a building structure, while in yet other instances the building structure itself may define a support surface for engagement with the retention roller 26. As will be seen from the FIG. 4 illustration, the combination of the guide rail 14*b*, guide roller 20*a*, retention roller 24*a*, and support rail 26*a* cooperate to provide a positive support for the door which strengthens it against both horizontal and vertical impacts and loads.

Figure 5:
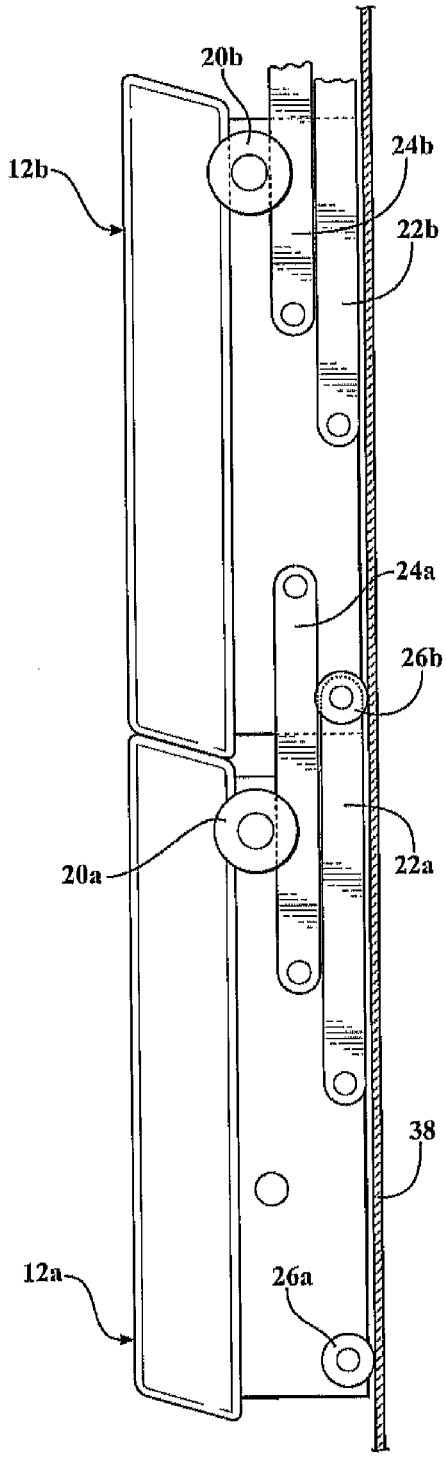
FIG. 5 is a side view of a portion of the door system of the present invention as shown in its closed position.

Referring now to FIG. 5, there is shown a side view of a portion of a door system of the present invention in its closed position. For purposes of illustration, FIG. 5 does not show a guide rail, it being understood that this rail would be engaged by the guide rollers as described with reference to FIG. 4. Specifically shown in FIG. 5 are two door panels 12*a*, 12*b*, each of which includes a facing member 28 and bracket 30. As previously described, each of the panels 12*a*, 12*b* also includes a guide roller 20, a primary connector link 22, and a secondary connector link 24.

FIG. 5 further illustrates the manner in which the retention rollers 26 engage a support rail 38 so as to retain the panels 12*a*, 12*b* in a spaced apart relationship with the rail and a building surface upon which the rail is mounted.

Figure 8:
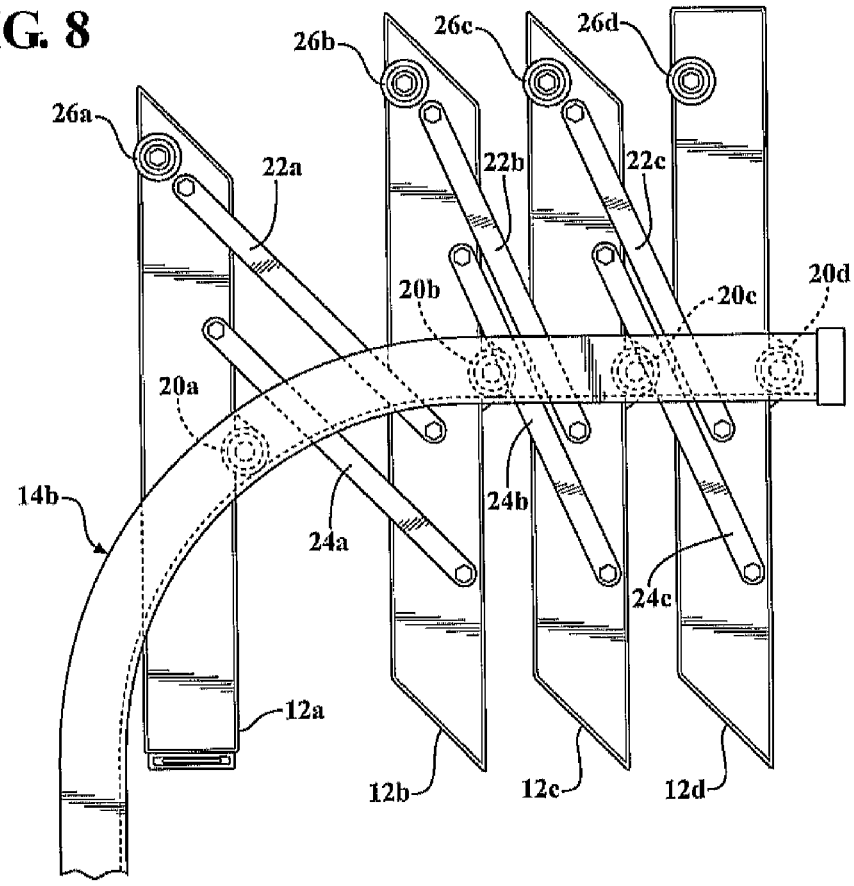
FIG. 8 is a right side view of another embodiment of a door system of the present invention in its open, storage position.

The door system of the present invention may be implemented in yet other configurations. FIGS. 8-10, which correspond generally to FIGS. 2-4 described above, depict another embodiment of the door system of the present invention wherein the positions of the guide rollers and retention rollers have been positioned other than as shown in the foregoing figures. Likewise, in the installation, the position of the support rail differs from that shown in FIG. 4. In FIGS. 8-10, features corresponding to those previously described will be referred to by like reference numerals.

Referring now to FIG. 8, there is shown a side view of a door assembly comprised of four panels 12*a*-12*d* wherein the door system is disposed in its open, storage position. In this regard, the door panels 12*a*-12*d* are suspended from a horizontal section of a track 14*b* by means of a plurality of guide rollers, 20*a*-20*d*. As in the previous embodiment, the panels, when in their storage position, are hanging vertically and are spaced apart from one another so that they are in an approximate plane parallel relationship. It will also be noted from this figure that each of the panels is mechanically connected to an adjoining panel or panels by means of a plurality of primary connector links 22*a*-22*c* and a plurality of secondary connector links 24*a*-24*c*. As explained above, the connector links axe pivotally connected to their respective panels so as to allow for relative motion between the panels.

As will be further noted from FIG. 8, the panels 12*a*-12*d* each includes a retention roller 26*a*-26*d* associated therewith.

This retention roller is generally similar to the retention rollers described with regard to the previous embodiment and likewise function to allow the panels, when the door is closed, to be retained in a spaced apart relationship with a support surface such as a portion of the building.

FIG. 9 is a perspective view of two panels 12*a*, 12*b* shown in an intermediate position between the horizontal and vertical sections of the track. FIG. 9 better illustrates the placement of the guide rollers 20*a* and 20*b*, and the retention rollers 26*a*, 26*b* with regard to the primary and secondary connector links 22, 24. The inventor hereof has found that in an embodiment of this type, the positioning of the guide rollers 20 stabilizes the motion of the panels, in particular instances, so as to minimize pivoting. Also, the positioning of the retention rollers provides for very good support for the door when it is in its closed position. It is to be understood that the panels of this embodiment may be configured to include a bracket/panel arrangement as described above. Also, it is to be understood that ancillary structures such as reinforcing beams and the like may be incorporated into the panels.

Referring now to FIG. 10, there is shown a partial cross-sectional view of the door assembly of this embodiment in its closed position. As shown therein, a panel 12*a* is supported in its guide rail 14*b* by a guide roller 20*a*, which is retained by a bracket 30*a*, and the guide rail 14 is in turn supported on a building structure 50 by a bracket 36. As depicted in FIG. 10, the panel 12*a* includes a retention roller 26*a* as previously described. This roller is supported on a side of the panel, and it is to be understood that the retention roller 26*a* may be directly affixed to the side of the panel, or it may be affixed to a bracket portion of the panel. As in the previous embodiment, the retention roller 26*a* serves to retain the panel in a spaced apart relationship with a support structure such as the building 50. In the FIG. 10 embodiment, the retention roller 26 engages a support rail 38 which in turn is affixed to the building structure 50. As will be apparent from the FIG. 10 embodiment, the combination of guide roller 20, track 14*b*, retention roller 26, and support rail 38 provides a very stable support for the panel 12*a* with regard to forces applied thereto from either its front or back face, while still allowing for ease of motion of the panel in a vertical plane. It is to be further understood that the various rollers may be otherwise disposed in relation to the panels; likewise, the number of connector links may be varied in other embodiments.

While some specific embodiments of the present invention have been shown, it is to be understood that this invention may be implemented in yet other embodiments, modifications, and variations so as to provide a door system which includes a single track guide rail which operates to direct a series of door panels between a vertical relationship in which their front faces are generally coplanar and their bottom edges are in a first plane parallel relationship and their top edges are in a second plane parallel relationship; and to an open configuration in which the panels are stored in a vertical, side-by-side relationship such that their front faces are generally in a spaced apart, plane parallel relationship and their bottom edges are in a first coplanar relationship while their top edges are in a second coplanar relationship. In view of the teaching presented herein, such embodiments will be apparent to those of skill in the art.

The foregoing drawings, discussion, and description illustrate some specific embodiments of the invention but are not meant to be limitations upon the practice thereof. It is the following claims, including all equivalents, which define the scope of the invention.

The invention claimed is:

1. A multiple panel, self-storing, vertical lift door system comprising:

a first and a second single track guide rail, each guide rail having a vertical segment and a horizontal segment;

a plurality of door panels, each panel having a front face, a back face, a top edge, a bottom edge, a first side edge, and a second side edge, each panel having a first guide roller supported on said first side edge, said first guide roller being engageable with said first guide rail so as to be displaceable therealong, each panel further including a second guide roller supported on said second side edge, said second guide roller being engageable with said second guide rail so as to be displaceable therealong; wherein when said guide rollers are engaged with the horizontal segment of their respective guide rails, they support said panels in a vertical relationship so that the bottom edges of the panels are in a coplanar relationship and the front edges of the panels are in a plane parallel relationship, and so that when the rollers are engaged with the vertical segment of their respective guide rails, they support said panels in a vertical relationship so that the front faces of the panels are in a coplanar relationship and the bottom edges of the panels are in a plane parallel relationship;

a plurality of primary connector links disposed and operative to pivotally connect the first edge of one of said panels to the first edge of another, adjoining one of said panels, and the second edge of said one of said panels to the second edge of said adjoining one of said panels;

a plurality of secondary connector links, each secondary connector link being pivotally affixed to one of said panels in a plane parallel relationship with a corresponding one of said primary connector links; and a drive system for moving said plurality of panels and their associated rollers along said first and second tracks between said vertical segment and said horizontal segment; whereby when said panels are disposed in said vertical segment, said door is in a closed position and when said panels are disposed in said horizontal segment, said door is in an open, storage, position.

2. The door system of claim 1, wherein said panels each include a first bracket which at least partially defines said first side edge of said panel, and a second bracket which at least partially defines said second side edge of said panel.

3. The door system of claim 2, wherein said panels each include a facing member which is attached to said first and second brackets, said facing member at least partially defining the top edge, the bottom edge, the first face, and the back face of said panel.

4. The door system of claim 2, wherein at least one of said first roller and one of said plurality of primary connector links is supported by said first bracket, and wherein at least one of said second roller and one of said primary connector links is supported by said second bracket.

5. The door system of claim 1, wherein the top edge and the bottom edge of at least some of said panels are beveled.

6. The door system of claim 5, wherein at least some of said bevels include a coupling feature.

7. The door system of claim 1, wherein at least some of said panels include a retention roller which is operative to retain said panel in a spaced apart relationship with a support surface when the door is in a closed position.

8. The door system of claim 7, further including a support rail which is disposed so as to contact said retention roller.

9. The door system of claim 1, wherein said drive system includes an electric motor.

10. The door system of claim 1, further including a remote control for activating said drive system.

* * * * *